United States Patent [19]

Epstein

[11] 4,170,237

[45] Oct. 9, 1979

[54] WATER PIPES WITH MEANS FOR PREVENTING WATER SPILLAGE

[76] Inventor: Kevin B. Epstein, 2775 Roscomare Rd., Los Angeles, Calif. 90024

[21] Appl. No.: 827,881

[22] Filed: Aug. 26, 1977

[51] Int. Cl.[2] ..... A24F 1/14

[52] U.S. Cl. ..... 131/173; 220/90.4

[58] Field of Search ..... 131/173, 211, 215 B, 131/216; 220/90.4

[56] References Cited

U.S. PATENT DOCUMENTS

| | | | |
|---|---|---|---|
| 2,414,697 | 1/1947 | Pettersson | 220/90.4 |
| 2,623,368 | 12/1958 | Olsen | 220/90.4 |
| 3,420,242 | 1/1969 | Bookair | 131/173 X |
| 4,031,904 | 6/1977 | Karl | 131/173 |

*Primary Examiner*—Stephen C. Pellegrino
*Attorney, Agent, or Firm*—Romney, Schaap, Golant, Disner & Ashen

[57] ABSTRACT

A water pipe of the type for smoking grown plant substances, and particularly the rare plant substances such as herbs and the like which are relatively expensive. The water pipe includes a first elongate tube having a central water chamber formed therein with a secondary tube extending into the water chamber and terminating beneath the normal level of water contained within the water chamber. At the upper end of the secondary tube is a bowl for containing the grown substance which is capable of being ignited for purposes of smoking. Disposed within the first tube above the water level thereof is a unique adapter which may be fixed within the first tube or otherwise removably disposed therein and which prevents the spillage of water from the upper end of the first tube in the event that the device is inadvertently tipped over. This adapter effectively works as a water entrapment device which permits the passage of smoke, but also prevents the spillage of water when the device is inadvertently tipped over.

19 Claims, 7 Drawing Figures

WATER PIPES WITH MEANS FOR PREVENTING WATER SPILLAGE

BACKGROUND OF THE INVENTION

This invention relates in general to certain new and useful improvements in smoking devices, and, more particularly, to improved smoking devices and water entrapment adapters used therefor which permit passage of smoke in the water smoking device, but prevent the spillage of water if the device is tipped over in a position where the water would flow outwardly therefrom.

Water smoking pipes have been well known in the art for many years and these devices generally include an elongate tube having a water chamber formed therein at the lower end thereof. A secondary tube enters the elongate tube and extends into the water in the water chamber thereof. At the upper end of the secondary tube, a bowl containing a burning plant substance, as for example, tobacco, herbs or the like, is capable of providing smoke which enters into the water chamber. The smoke passes through the water contained within the water chamber and is capable of being inhaled by the smoker out through the upper open end of the elongate tube.

In recent years, there has been a substantially increased interest in these forms of water pipes due to the fact that various smoking herbs and like grown plant substances are more readily available for smoking purposes. Notwithstanding, many people in the present-day society prefer to smoke tobacco substances with the aid of a water pipe due to the fact that increased emjoyment is provided thereby.

One of the principal problems with respect to the present-day water smoking pipe is the fact that water would tend to spill from the pipe in the event that it was inadvertently tipped over. Due to the fact that the elongate tube which contains the water chamber is relatively tall and of relatively narrow cross-sectional dimension, the device tended to tip over rather easily, thereby resulting in inadvertent water spillage. There has been at least one attempt to provide a water pipe which was designed to overcome the problem of water spillage in the event that the water pipe tipped over, and such device is more fully described in U.S. Pat. No. 3,872,872 dated Mar. 25, 1975, to Richard Kahler. However, devices of this type have been relatively ineffective in that they do not particularly prevent the splashing of water outwardly of the pipe when the water pipe is tipped over. For example, in the aforementioned Kahler Patent, the upper end of the elongate tube is provided with a plurality of apertures which was designed to permit the passage of smoke, and it was contended that it would obviate the problem of water spillage in the event that the pipe tipped over.

One of the principal problems of this type of pipe in the Kahler patent is that the water would tend to splash against the cap on the upper open end of the elongate tube such that water would actually pass through the relatively small apertures. In addition, smoking with the pipe was impaired inasmuch as it was difficult to withdraw smoke from the chamber formed of the elongate tube. Thus, devices of the type taught in the Kahler Patent were not only ineffective for the purpose of preventing liquid spillage, but were also ineffective in that they did not enable the smoker to enjoy the smoking value of the pipe due to the increased effort required on the part of the smoker.

The present invention obviates those and other problems in the provision of a unique water entrapment device which is located within the elongate tube of the water pipe and which permits easy inhalation of the smoke contained in the elongate tube but effectively prevents the spillage of water in the event of inadvertent tipping of the water pipe.

OBJECTS OF THE INVENTION

It is, therefore, a primary object of the present invention to provide a new and improved water smoking pipe which permits the easy passage of smoke form a burning grown plant substance but which also effectively prevents the spillage of water in the event that the pipe is inadvertently tipped over.

It is another object of the present invention to provide a water smoking pipe of the type stated which is uniquely designed so that it can be constructed in a relatively economical manner.

It is a further object of the present invention to provide a water entrapment adapter for use in water smoking pipes and which permits the easy passage and inhalation of smoke contained within the water chamber of the pipe which effectively prevents spillage of water in the event of inadvertent tipping of the pipe.

It is an additional object of the present invention to provide an adapter of the type stated which can be used in a wide variety of water smoking pipes.

It is another salient object of the present invention to provide a water smoking pipe of the type stated which is sturdy and rugged in its construction.

It is also an object of the present invention to provide a water smoking pipe of the type stated which is relatively portable and which can be easily disassembled for purposes of cleaning.

With the above and other objects in view, my invention resides in the novel features of form, construction, arrangement and combination of parts presently described and pointed out in the claims.

SUMMARY OF THE DISCLOSURE

The present invention relates to a water smoking pipe of the type comprising a first elongate hollow tube having an open upper end and a closed lower end which thereby provides a water chamber and a smoke accumulating chamber located above the water chamber. A second elongate hollow tube extends through the first tube and has a lower end terminating in the water chamber of the first tube. A means is provided on the outer end of the second elongate hollow tube for retaining a burnable grown plant substance. This latter means is typically a bowl for retaining tobacco or grown plant herbs or similar grown plant substances. In this way, smoke from the burnable substance, when ignited, can pass through the second tube, through the water chamber and into the smoke accumulating chamber.

The water pipe of the present invention is designed to include a water entrapment device located in the first tube. This water entrapment device has a first section in water sealing contact with the first tube. The water entrapment means also includes a second section spaced from the interior surface of the first tube in order to collect water if the pipe is tipped over to thereby prevent water from spilling out of the pipe. In addition, the water entrapment means includes an opening there through so that smoke can be withdrawn from the smoke accumulation chamber, and which is located so that water will accumulate in the space between the second pipe section and the first tube if the pipe is tipped over. This opening is located relative to the amount of water in the water chamber so that water will not pass through the opening if the pipe is tipped over.

In a preferred embodiment of the present invention, the opening is located in approximately the center of the interior of the first tube and the level of water in the first tube, if tipped over, is below the level of this opening.

In one embodiment of the present invention, the water entrapment device comprises a conically shaped plug which includes a water accumulation area below the level of the opening. The conically shaped plug has a first opening in communication with the smoke accumulation chamber and a second opening communicating with the open upper end of the first tube. The two openings communicate with a water collection area in the plug and are located beneath the first and second openings when the pipe is in a horizontal position.

In another embodiment of the present invention, the water entrapment means comprises a first entrapment tube section spaced from the interior surface of the first tube thereby creating a water collection area and a wall extending from the entrapment tube contacting the interior surface of the first tube. In this way, water would collect in the water collection area without spilling from the tube in the event of inadvertent tipping over of the tube. Moreover, the wall extending from the entrapment tube is located in an angular relationship in a preferred embodiment such that it is conically shaped toward the open upper end of the first elongate hollow tube. In another embodiment of the present invention, this wall is perpendicular to the entrapment tube.

In another preferred aspect of the present invention, the closed lower end of the first tube comprises a removable base cap which is removable from the lower end of the first tube and the second tube is also removable from the first tube. In addition, the means for retaining the burnable plant substance, such as the bowl, is removable from the second tube. In this way, all of the components of the smoking device can be removable for easy cleaning and for storage within the first tube such that the device is easily transportable.

In another aspect of the present invention, an adapter is provided for use with the smoking pipe. This adapter has been immediately described above. In each of the embodiments of the adapter, the adapter is so constructed so that it will retain the water within the water chamber of the smoking pipe when the pipe is tipped over, but will not interfere with the passage of smoke from the burning plant substance through the smoking chamber.

As used herein, the term "water smoking pipe" or the term "water pipe" are used to refer to those forms of smoking pipes in which smoke from a burnable plant substance is passed through water or similar liquid before being taken in or inhaled by the user of the pipe.

BRIEF DESCRIPTION OF THE DRAWINGS

Figure 1:
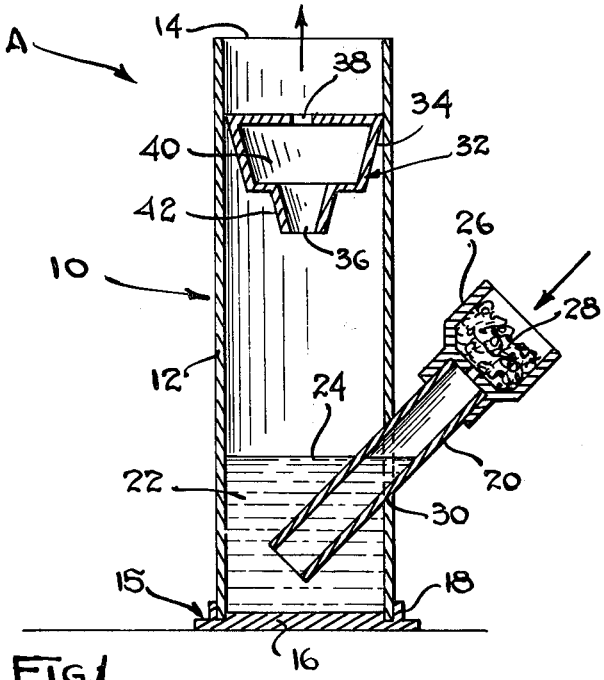
Figure 6:
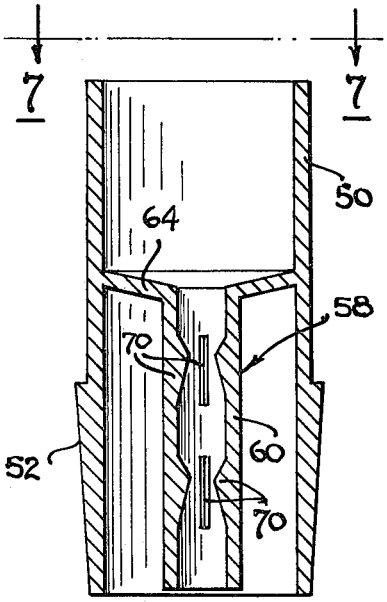
Figure 7:
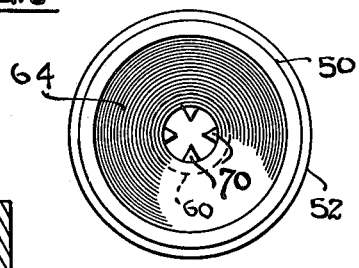
Figure 2:
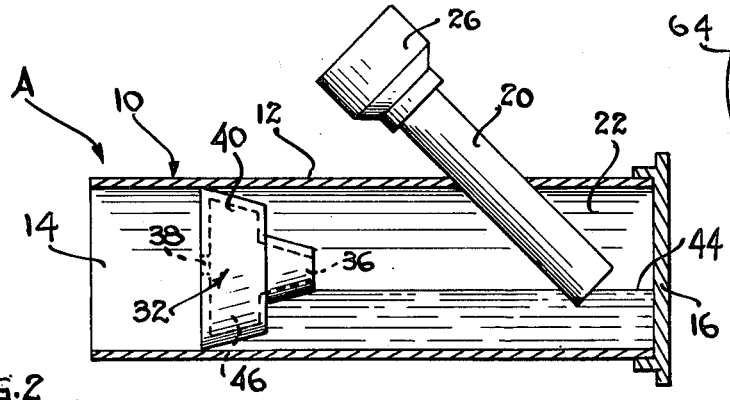
Figure 3:
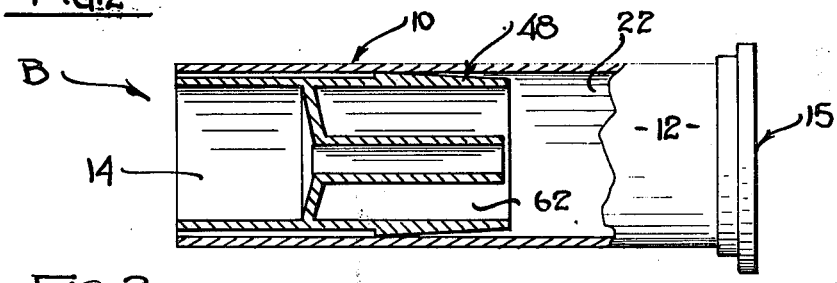
Figure 4:
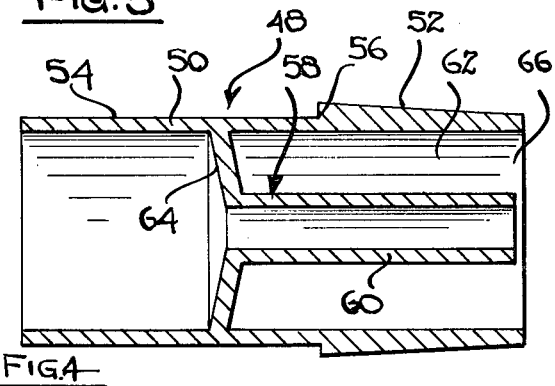
Figure 5:
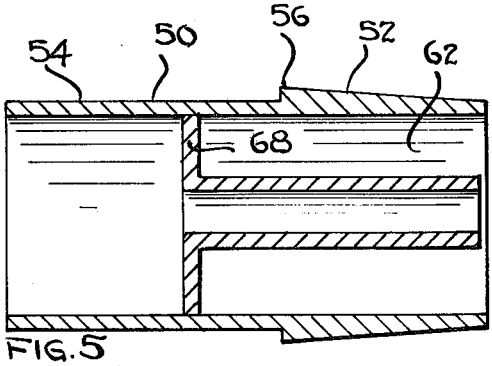

Having thus described the invention in general terms, reference will now be made to the accompanying drawings in which:

FIG. 1 is a vertical sectional view of a water smoking pipe constructed in accordance with and embodying the present invention;

FIG. 2 is a side elevational view, partially shown in section, and showing the water smoking pipe in a position where the pipe has been tilted over and thereby prevents the inadvertent spillage of water from the water smoking pipe;

FIG. 3 is a vertical sectional view, somewhat similar to FIG. 2, and showing a modified form of water smoking pipe in accordance with and emboding the present invention;

FIG. 4 is a vertical sectional view, showing an adapter of the type used in the water smoking pipe of FIG. 3;

FIG. 5 is a vertical sectional view, similar to FIG. 4, and showing a modified form of adapter for use in the present invention;

FIG. 6 is a vertical sectional view of an adapter, somewhat similar to FIG. 4, and showing yet another modified form of adapter for use in the present invention;

FIG. 7 is an end elevational view taken substantially along line 7—7 of FIG. 6.

DETAILED DESCRIPTION

Referring now in more detail and by reference characters to the drawings which illustrate preferred embodiments of the present invention, A designates a water smoking pipe comprised of an upstanding elongate tube 10 which is generally circular in cross section. The tube 10 is comprised of a cylindrically shaped side wall 12 having an open upper end 14. The tube 12 is initially also provided with an open lower end, but which is covered by a removable base cap 15. In this case, the base cap 15 includes a relatively flat bottom wall 16 and a peripheral upstanding end flange 18, which snugly engages the exterior surface of the tube 12 in a watertight sealing engagement. In this way, the base cap 15 can be removed for purposes of cleaning and disassembly of the water smoking pipe A. Nevertheless, it should be understood that the base cap 15 could be integrally molded with or otherwise secured to the lower end of the tube 12.

It should be understood with the present invention that the water smoking pipe A could adopt essentially any form of rectangular cross section, although the cylindrical form of cross section is preferred due to the convenience of manufacture. In the event that the water smoking pipe A adopted a cross-sectional shape other than that of circular, it would be understood that the base cap 15 would adopt a similar shape.

The water smoking pipe, including the various components forming a part thereof, as well as the adapter used therewith, may be formed of any of a number of known plastic materials, such as polyethylene, polystyrene, polybutiene or copolymers thereof or the like. Thus, the various components could be blow-molded, thermo-formed, injected molded or formed in any of the other known plastic molding operations. Nevertheless, it should be understood that the water smoking pipe, as well as the components forming a part thereof, and as well as the adapter thereof, could be formed of any of a number of known materials, including metals such as aluminium, steel or the like, as well as wood or other substances. However, the bowl, hereinafter described, would be formed of a briar wood or like material not capable of melting from the heat of the plant substance.

Extending into the side wall 12 of the tube 10 is a secondary tube 20 and which is also preferably cylindrical in shape. The secondary tube 20 extends into a water chamber 22 formed within the lower end of the tube 12, in the manner as illustrated in FIG. 1 of the drawings. In this case, it can be observed that the lower end of the tube 20 is below the water level 24 as illustrated in FIG. 1 of the drawings. Threadedly and removably secured to the outer and upper end of the secondary tube 20 is a bowl 26 capable of retaining a burning plant substance designated as 28. In this case, it can be observed that the bowl 26 is threadedly secured to the secondary tube 20 for purposes of removal and easy cleaning. However, it should also be observed that the bowl 26 could be integral therewith or otherwise securely attached to the tube 20. Nevertheless, the bowl 26 contains any substance capable of ignition for generating smoke of the type which is capable of being smoked by a human individual. Thus, forms of burning plant substances which may be used are normal tobacco leaves and particularly refined tobacco products, various known grown plant herbs and the like.

By further reference to FIG. 1, it should be observed that the secondary tube 20 is fitted within aperture 20 located within the cylindrical side wall 12 of the tube 10 and is snugly engaged therewith so as to prevent any water leakage through the aperture 30. For this purpose, suitable water sealing adhesives or the like could be employed. In a more preferred aspect, the secondary tube 20 could be slightly tapered so as to fit within the aperture 30 in a snug fitting liquid-tight engagement therewith.

Referring again to FIGS. 1 and 2, it can be observed that a water entrapment adapter 32 is disposed within the elongate tube 12 near the upper open end 14 thereof. The water entrapment adapter 32 comprises a conically shaped plug 34 having an aperture 36 at its lower end and an aperture 38 at its upper end which communicates with a hollow interior chamber 40. In this case, and in the preferred embodiment of this type of adapter 32, the adapter 32 includes a second conically shaped section 42 in which the open lower end 36 is located. This lower section 42 may be integrally formed with or otherwise secured to the adapter 32 in the manner as illustrated in FIGS. 1 and 2 of the drawings.

By reference to FIG. 2, it can be observed that if the water pipe is inadvertently tipped over to a relatively horizontal position as illustrated therein, the level of water in the water chamber 22 will assume a level designated by reference numeral 44 as illustrated in FIG. 2. In this case, it can be observed that the level of water is below the apertures 36 and 38. Even more importantly, it is to be observed that the lower aperture 36 is located in such position that if any water did pass through the aperture 36, it would immediately be accumulated within a lower conically shaped water collection section 46 within the adapter 32, in the manner as illustrated in FIG. 2 of the drawings. Thus, in this way, it can be observed that if any water did pass through the aperture 36, it would very unlikely pass through the aperture 38 and out of the water smoking pipe and would thus accumulate within the lower section 46 as illustrated in FIG. 2. Accordingly, when the water smoking pipe is returned to its upright position as illustrated in FIG. 1, the water would drain back outwardly through the lower aperture 36 and into the liquid chamber 22.

The apertures 36 and 38 are sufficiently large to permit the passage of smoke contained within the interior of the tube 12 without creating any undue burden on the smoker using the pipe A. However, these apertures are sufficiently small so that they do attempt to create an impedance to water passing through both of the apertures 36 and 38. While the conically shaped plug 32 may not necessarily completely prevent the passage of all water passing through the aperture 36 in the event of splashing, the water passing through this aperture 36 will almost necessarily accumulate in the lower portion 46 of the plug 32.

FIG. 3 discloses a modified form of water smoking pipe B constructed in accordance with and embodying the present invention and which includes a cylindrically shaped tube 12 along with the lower end cap 15 and which may be secured to the tube 12 in the same conventional manner. The water smoking pipe B is provided with the same open upper end 14. In this case, the water smoking pipe B is provided with a slightly different adapter 48 which is designed to prevent spillage of water but which permits the passage of smoke through the upper open end 14.

The adapter 48 is more fully illustrated in FIGS. 3 and 4 of the drawings and in this case comprises a cylindrically shaped tube 50 which includes a tapered wall section 52 at its right-hand end with reference being made to FIG. 3, and a relatively cylindrically shaped tube section 54 of essentially consent cross section at its opposite end. In this respect, the adapter 48 is shown in a longitudinal position, that is, the position it would adopt if the smoking pipe were tipped over. Thus, when the adapter 48 is used in a smoking pipe in an upright position, the tapered section would be the lower end of the adapter and the cylindrically shaped section would be the upper end. An outwardly extending annular tapered flange 56 is located between the tube section 52 and the tube section 54 in the manner as illustrated in FIG. 4. In this way, the outwardly extending flange 56 is designed to engage the interior surface of the side wall of 12 in order to snugly fit within the tube 10. One of the purposes of the outwardly extending tapered flange 56 is to account for nonlinearities which may otherwise arise in the molding of the tube 10. In addition, the flange 56 is designed to provide a proper liquid-tight fitting engagement with the interior surface of the tube 10. In this respect, it should be observed that one or more flanges 56 may be spaced apart from each other and located axially along the tube 50.

The adapter 48 is designed to be slidably, but nevertheless snugly, fitted within the open (upper) end of the tube 10 in the manner as illustrated in FIG. 3. In this respect, it can be observed that the adapter 48 can be designed in a wide variety of shapes and sizes to accommodate essentially any commercially available water smoking pipe. In this way, a conventional water smoking pipe could accommodate the adapter of the present invention in order to prevent water spillage therefrom.

Returning again to FIG. 4, it can be observed that the tube 50 is provided with a diametrically reduced interiorly located and concentrically extending tube section 58. In this case, the tube section 58 includes a cylindrically shaped diametrically reduced tube 60 which is spaced from the interior surface of the tube 50 so as to create a water collection or accumulation chamber 62 therebetween. The open end of the interior tube 60 is provided with an upwardly and outwardly flaring annular wall section 64 which extends to the interior wall of the tube 50, in the manner as illustrated in FIG. 4. In this way, it can be observed that if the water smoking pipe B of the present invention was inadvertently tipped over in the manner as illustrated in FIG. 3, water would tend to accumulate within the water accumulation chamber 62 and would not necessarily pass through the essentially long distance of the tube 58. In this same respect, the tube 58 can be tapered outwardly continuously from the outwardly flaring end 64 toward the lower open end 66.

In this way, any water which might tend to enter into the tube 58 would thereby drain therefrom and into the water chamber 22, or otherwise into the water accumulation chamber 62.

In the preferred embodiment of the present invention, the water entrapment adapter 48 has an overall diametral size with an interior diameter of about $2\frac{5}{8}$ inches with the interior portion of the interior tube 58 having a diameter of $\frac{3}{8}$ inches. Thus, the distance from the interior surface of the tube 50 to the interior surface of the tube 58 would have a radius of $1\frac{1}{8}$ inches. Moreover, the outwardly extending flange 56 would have an overall dimension of about 1/16 inches projecting outwardly from the outer surface of the tube 50, in the manner as illustrated in FIG. 4 of the drawings. Finally, the upper end 64 would taper in such manner that the angle of taper is approximately $\frac{1}{8}$ inch.

FIG. 5 discloses a modified form of adapter for use with the water smoking pipe and which is very similar to the adapter of FIG. 4. However, in this case, the adapter of FIG. 5 includes an end wall 68 which is relatively perpendicular to the interior tube 60 and engages the interior surface of the outer tube 50 in the manner as illustrated in FIG. 5. The construction of FIG. 5 is not as desirable as the construction of FIG. 4, but is nevertheless highly effective in the present invention.

In another modified form of the adapted of the present invention, it can be observed that the interior surface of the adapter is provided with a plurality of interiorly presented abutments 70 serving as water barriers which are arranged around the interior surface of the tube 60 in the manner as illustrated in FIGS. 6 and 7 of the drawings. In this way, if the water does happen to enter into the interior of the tube 60 through the lower end 66, it is prevented from splashing out by means of the abutments 70.

Referring again to the various figures of the drawings, it can be observed that the smoking device of the present invention is relatively simple to maintain and be easily disassembled for purposes of cleaning. Thus, the lower end cap 16 can be removed and, in like manner, the adapter 32, or otherwise the adapter 48, can be easily removed therefrom. Even moreso, and in some embodiments of the invention, the secondary tube 20 along with the bowl 26 can be removed for purposes of cleaning. In addition, the bowl 26 in many embodiments can be removed from the secondary tube 20. Moreover, these parts are relatively interchangeable so that one or more of the parts can be substituted for any other part which may be damaged.

In smoking the device of the present invention, the smoker places his lips near to the open upper end 14 or over the outer cylindrical side wall of the tube 12 at the open upper end 14 in order to inhale smoke which may be generated through the secondary tube 20 and into the interior chamber of the tube 12. The portion above the water line 24 actually constitutes a smoke chamber in which smoke will accumulate. It is important to note that withdrawal of the smoke from the smoking chamber is quite easy and convenient inasmuch as the adapter 32 or otherwise the adapter 48 does not interfere with the passage of smoke. Moreover, due to the volume of the adapter in the smoking chamber, less suction is required in order to remove the smoke.

Thus, there has been illustrated and described a unique and novel water smoking pipe and a unique adapter therefor constructed with and embodying the present invention. This unique smoking pipe and the adapter therefor fulfills all of the objects and advantages sought therefor. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention which is limited only by the following claims.

Having thus described my invention, what I desire to claim and secure by letters patent is:

1. A water pipe comprising:

(a) a first elongate hollow tube having an open upper end and a closed lower end providing a water chamber and a smoke accumulating chamber above said water chamber, (b) a second elongate hollow tube extending through said first tube and having a lower end terminating in said water chamber of said first tube, (c) a means for retaining a burnable grown plant substance on the outer end of said second tube such that smoke from said burnable substance when ignited can pass through said second tube through water in said water chamber into said smoking accumulating chamber, (d) water entrapment means located in said first tube and comprising an elongate tubular member having an engagement portion extending fully around the periphery thereof in water sealing contact with the interior surface of said first elongate tube to prevent water in the water chamber from passing between the tubular member and the interior surface of said first tube, said water entrapment means also comprising a wall extending across a portion of said elongate tubular member generally transversely to said first elongate hollow tube and said elongate tubular member, said tubular member and said wall cooperating with the interior surface of said first elongate hollow tube to form a water entrapment area to collect water if the pipe is tipped over, and (e) means forming an opening through said wall of said water entrapment means so that smoke can be withdrawn from said smoke accumulation chamber but which is located so that water will accumulate in the water entrapment area if said pipe is tipped over, said opening being located relative to the amount of water in said water chamber so that water will not pass through said opening if said pipe is tipped over.

2. The water pipe of claim 1 further characterized in that said opening is located approximately in the center of the interior of said wall and which wall is positioned so that the opening is approximately in the center of the interior of said first tube, and the level of water in said first tube, if tipped over, is below the level of said opening.

3. The water pipe of claim 1 further characterized in that the elongate tubular member of said water entrapment device comprises a conically shaped plug which includes said water entrapment area below the level of said opening.

4. The water pipe of claim 3 further characterized in that said conically shaped plug has a first opening in communication with said smoke accumulation chamber and a second opening communicating with the open upper end, said water entrapment area being located beneath said first and second openings when said water pipe is in a horizontal position.

5. The water pipe of claim 3 further characterized in that said means for retaining a burnable plant substance is removable from said second tube.

6. The water pipe of claim 1 further characterized in that said closed lower end comprises a removable base cap which is removable from the lower end of said first tube and said second tube is removable from said first tube.

7. The water pipe of claim 1 further characterized in that said wall is conically shaped and extends from said elongate tubular member at an angular relationship such that it is conically shaped toward the upper end of said first elongate hollow tube.

8. The water pipe of claim 1 further characterized in that said wall is perpendicular to said entrapment tube.

9. An adapter for use with a water smoking pipe of the type having a first elongate hollow tube with an open upper end and a closed lower end and with a second elongate hollow tube extending into said first tube and having a lower end terminating in a water chamber in said first tube, and second tube having a bowl at the outer end for retaining a grown plant substance capable of producing smoke upon ignition when the smoke passes through the water in said first tube to be taken in by an individual, said adapter capable of passing said smoke but preventing passage of water in the event that said smoking pipe is tipped over, said adapter comprising an elongate tubular member having an engagement portion extending fully around the periphery thereof and adapted for water sealing contact with the interior surface of said first elongate tube to prevent water in the water chamber from passing between the tubular member and the interior surface of said first tube, said adapter also comprising a wall extending across a portion of said elongate tubular member generally transversely to said first elongate hollow tube and said elongate tubular member, said tubular member and said wall cooperatable with the interior surface of said first elongate hollow tube to form a water entrapment area to collect water if the pipe is tipped over, and means forming an opening through said adapter so that smoke can be withdrawn from said first tube but which is located so that water will accumulate in the space between said second section and said first tube if said pipe is tipped over, said opening being located relative to the amount of water in said water chamber so that water will not pass through said opening if said pipe is tipped over.

10. The adapter of claim 9 further characterized in that said opening is located approximately in the center of the interior of said wall and which wall is positioned so that the opening is approximately in the center of the interior of said first tube and the level of water in said first tube, if tipped over, is below the level of said opening.

11. The adapter of claim 9 further characterized in that the elongate tubular member of said adapter comprises a conically shaped plug which includes said water entrapment area below the level of said opening.

12. The adapter of claim 11 further characterized in that said conically shaped plug has a first opening in communication with the water chamber formed of said first tube, and a second opening communicating with the open upper end of said first tube, said water entrapment area being located beneath said first and second openings when said water pipe is in a horizontal position.

13. The adapter of claim 9 further characterized in that said wall is conically shaped and extends from said elongate tubular member at an angular relationship such that it is conically shaped toward the upper end of said first elongate tube.

14. The adapter of claim 9 further characterized in that said wall is perpendicular to said entrapment tube.

15. A water pipe comprising:

(a) a first elongate hollow tube having an open upper end and a closed lower end providing a water chamber and a smoke accumulating chamber above said water chamber, (b) a second elongate hollow tube extending through said first tube and having a lower end terminating in said water chamber of said first tube, (c) a means for retaining a burnable grown plant substance on the outer end of said second tube such that smoke from said burnable substance when ignited can pass through said second tube through water in said water chamber into said smoke accumulating chamber, (d) water entrapment means located in said first tube and having a first entrapment tube section spaced from the interior surface of the first tube and a wall extending from said entrapment tube section and contacting the interior surface of said first tube thereby creating a water collection area to collect water if the pipe is tipped over, said wall being conically shaped and extending from said entrapment tube section at an angular relationship such that the conical shape faces the upper end of said first elongate tube, and (e) means forming an opening through said water entrapment means so that smoke can be withdrawn from said smoke accumulation chamber but which is located so that water will accumulate in the space between said entrapment tube section and said first tube if said pipe is tipped over, said opening being located relative to the amount of water in said water chamber so that water will not pass through said opening if said pipe is tipped over.

16. A water pipe comprising:

(a) a first elongate hollow tube having an open upper end and a closed lower end providing a water chamber and a smoke accumulating chamber above said water chamber, (b) a second elongate hollow tube extending through said first tube and having a lower end terminating in said water chamber of said first tube, (c) a means for retaining a burnable grown plant substance on the outer end of said second tube such that smoke from said burnable substance when ignited can pass through said second tube through water in said water chamber into said smoke accumulating chamber, (d) water entrapment means located in said first tube and having a first entrapment tube section spaced from the interior surface of the first tube and a wall extending from said entrapment tube section and contacting the interior surface of said first tube thereby creating a water collection area to collect water if the pipe is tipped over, said wall being perpendicular with respect to said entrapment tube section, and (e) means forming an opening through said water entrapment means so that smoke can be withdrawn from said smoke accumulation chamber but which is located so that water will accumulate in the space between said entrapment tube section and said first tube if said pipe is tipped over, said opening being located relative to the amount of water in said water chamber so that water will not pass through said opening if said pipe is tipped over.

17. An adapter for use with a water smoking pipe of the type having a first elongate hollow tube with an open upper end and a closed lower end and with a second elongate hollow tube extending into said first tube and having a lower end terminating in a water chamber in said first tube, and said second tube having a bowl at the outer end for retaining a grown plant substance capable of producing smoke upon ignition when the smoke passes through the water in said first tube to be taken in by an individual, said adapter capable of passing said smoke but preventing passage of water in the event that said smoking pipe is tipped over, said adapter comprising an entrapment tube section located to be spaced from the interior surface of the first tube and a wall extending from said entrapment tube section and adapted to contact the interior surface of said first tube, thereby creating a water collection area to collect water if the pipe is tipped over, said wall being conically shaped and extending from said entrapment tube section at an annular relationship such that the conical shape faces the upper end of said first elongate tube, and means forming an opening through said adapter so that smoke can be withdrawn from said first tube but which is located so that water will accumulate in the space between said entrapment tube section and said first tube if said pipe is tipped over, said opening being located relative to the amount of water in said water chamber so that water will not pass through said opening if said pipe is tipped over.

18. An adapter for use with a water smoking pipe of the type having a first elongate hollow tube with an open upper end and a closed lower end with a second elongate hollow tube extending into said first tube and having a lower end terminating in a water chamber in said first tube, and said second tube having a bowl at the outer end for retaining a grown plant substance capable of producing smoke upon ignition when the smoke passes through the water in said first tube to be taken in by an individual, said adapter capable of passing said smoke but preventing passage of water in the event that said smoking pipe is tipped over, said adapter comprising an entrapment tube section located to be spaced from the interior surface of the first tube and a wall extending from said entrapment tube section and adapted to contact the interior surface of said first tube thereby creating a water collection area to collect water if the pipe is tipped over, said wall being perpendicular with respect to said entrapment tube section, and means forming an opening through said adapter so that smoke can be withdrawn from said first tube but which is located so that water will accumulate in the space between said entrapment tube section and said first tube if said pipe is tipped over, said opening being located relative to the amount of water in said water chamber so that water will not pass through said opening if said pipe is tipped over.

19. A water pipe comprising:

(a) a first elongate hollow tube having an open upper end and a closed lower end providing a water chamber and a smoke accumulating chamber above said water chamber, (b) a second elongate hollow tube extending through said first tube and having a lower end terminating in said water chamber of said first tube, (c) a means for retaining a burnable grown plant substance on the outer end of said second tube such that smoke from said burnable substance when ignited can pass through said second tube through water in said water chamber into said smoke accumulating chamber, (d) water entrapment means located in said first tube and comprising an elongate tubular member having an engagement portion extending fully around the periphery thereof in water sealing contact with the interior surface of said first elongate tube to prevent water in the water chamber from passing between the tubular member and the interior surface of said first tube, said water entrapment means also comprising a wall extending across a portion of said elongate tubular member generally transversely and perpendicular to said first elongate hollow tube and said elongate tubular member, said tubular member and said wall cooperating with the interior surface of said first elongate hollow tube to form a water entrapment area to collect water if the pipe is tipped over, (e) means forming a first opening through the wall of said tube communicating with the first upper end of said tube and means forming a second opening in said water elongate tubular member communicating with the water chamber in said first tube so that smoke can be drawn from said smoke accumulating chamber and through said opening and out of the upper end of said first tube, said water accumulating area being located beneath said first and second openings when said water pipe is in a horizontal position so that water will accumulate in the water entrapment area if said pipe is tipped over, said openings being located substantially in the center of said first tube and located relative to the amount of water in said water chamber so that water will not pass through said openings if said pipe is tipped over.

* * * * *